United States Patent [19]

Sexton et al.

[11] 4,341,823

[45] Jul. 27, 1982

[54] METHOD OF FABRICATING A FIBER REINFORCED METAL COMPOSITE

[75] Inventors: Richard W. Sexton, Grove City; David M. Goddard, Powell, both of Ohio

[73] Assignee: Material Concepts, Inc., Columbus, Ohio

[21] Appl. No.: 224,869

[22] Filed: Jan. 14, 1981

[51] Int. Cl.[3] ..... B32B 15/02

[52] U.S. Cl. ..... 427/404; 427/305; 427/443.1; 427/433; 428/614; 428/634

[58] Field of Search ..... 428/614, 634, 608; 427/305, 404, 217, 443.1, 433; 164/75, 100, 108

[56] References Cited

U.S. PATENT DOCUMENTS

| | | | |
|---|---|---|---|
| 3,571,901 | 3/1971 | Sara | 428/614 |
| 3,622,283 | 11/1971 | Sara | 428/634 |
| 3,720,257 | 3/1973 | Beutler et al. | 428/634 |
| 4,141,802 | 2/1979 | Duparque et al. | 428/608 |

*Primary Examiner*—Ralph S. Kendall

*Attorney, Agent, or Firm*—John L. Gray

[57] ABSTRACT

The present invention comprises a process of preparing metal matrix composites which are reinforced by ceramic or graphite fibers, wherein the fibers are pretreated; first by a nickel coating, then by a second coating which is sacrificed when the fibers are ultimately immersed in a liquid metallic bath which becomes the matrix of the composite material formed. Usually the second coating is copper.

In addition, a third coating on the fibers comprising a noble metal such as silver may also be used for certain matrix metal materials. Preferably the thickness of the nickel coating is a minimum of 0.5 micrometers and the second sacrificial coating is a minimum of 0.5 micrometers. After the fibers have been coated with the two or more successive coatings, they are incorporated into a metal matrix composite material by immersion in a molten bath of the desired matrix metal, or by placing the fibers in a suitable mold and casting the molten metal matrix around them, or by other suitable means. This may be done under ordinary atmospheric conditions without the use of vacuum or a protective atmosphere.

11 Claims, 2 Drawing Figures

METHOD OF FABRICATING A FIBER REINFORCED METAL COMPOSITE

SUMMARY OF INVENTION

The invention comprises a process of pretreating ceramic or graphite fibers prior to incorporating them in a metal matrix. The pretreatment involves coating the individual fibers with a nickel coating followed by a subsequent copper coating which becomes sacrificed when the fibers are immersed in a molten metal bath. A third coating on the fibers of noble metal such as silver may also be used in certain circumstances. Because of the pretreatment of the fibers, it is possible to immerse the coated fibers in the molten metal under ordinary atmospheric conditions without the use of vacuum or a protective atmosphere.

The coated fibers may be immersed in a molten bath of the desired matrix material, or placed in a suitable mold following which the molten matrix metal is cast around the fibers, or the fibers may be incorporated into the molten matrix material by any other suitable means. Molten metal matrix materials which are particularly useful in connection with this process are lead, aluminum, tin, or alloys of these materials.

Metal matrix composite materials consisting typically of high-strength, high-modulus, nonmetallic fibers in a metal matrix have use in a wide variety of industrial and military applications because they offer a combination of the physical properties of the metal with the mechanical high-strength properties of the fibers. In order for optimum mechanical properties to be achieved in the composite, good bonding must occur between the fibers and the matrix. Moreover, significant economies can be achieved if the process of bonding the fibers to the matrix metal can be carried out under ordinary atmospheric conditions without the utilization of special vacuum furnaces, or the use of protective atmospheres.

It is therefore an object of this invention to prepare metal matrix composite materials by first depositing on ceramic or graphite fibers a nickel coating and thereafter depositing on said nickel coated fiber a copper coating.

It is another object of this invention to prepare a metal matrix composite material by first coating a ceramic or graphite fiber with nickel, then with copper, and then with silver, or some other suitable noble metal.

It is a still further object of this invention to produce a metal matrix composite material utilizing said dual or treble-coated fibers by immersion of said fibers in a molten bath of matrix materials, or by other suitable means, said matrix materials consisting of lead, aluminum, tin, or alloys thereof wherein the lead, aluminum, or tin is the dominant alloying constituent.

This, together with other objects and advantages of the invention, should become apparent in the details of the invention as more fully described in the drawings and specification hereinafter and as claimed herein.

DETAILED DESCRIPTION OF THE INVENTION

If the ceramic or graphite fibers are coated first with nickel and then with copper, they may be immersed in the matrix-forming molten bath materials under ordinary atmospheric conditions and it is not necessary to provide a vacuum furnace or a protective atmosphere as otherwise would be the case if the fibers were not previously so coated.

While various thicknesses of nickel and copper may be utilized, it has been found that a minimum thickness of 0.5 micrometers of nickel and 0.5 micrometers of copper are desirable because complete infiltration by the molten matrix material is achieved whereas below this thickness of coating metals complete infiltration of the matrix metal is not necessarily obtained. The metal coatings may be placed on the fibers using a variety of techniques. Electroless or electroplating processes are useful in achieving good adherent coatings of the metal to the fibers. In the case of ceramic fibers, electroplating is not effective so electroless plating is utilized. In the case of graphite fibers, electroplating processes may be employed. For some applications, the copper coating is followed by a noble metal coating, usually silver. A silver coating of from 0.05 to 0.1 micrometers has been found to be adequate when that particular coating is utilized. The silver coating is particularly useful when the metal matrix material is lead.

The coated fibers may be immersed in a liquid metal matrix material or may be cast in a suitable mold with the metal matrix material.

The term "ceramic" as used herein means any fibrous material consisting of coherent oxides of silicon, sodium, aluminum, boron, or refractory metals and impurities.

The term "graphite" includes all forms of fiber of which the primary constituent is carbon.

Electroless nickel plating constitutes heat catalyzed reactions for plating nickel such as those involving hypophosphite or amine borane as specific examples. There are, of course, other commercially available processes. The method of applying nickel or any other coating should not be construed as limiting the intent or scope of the invention.

Figure 1:
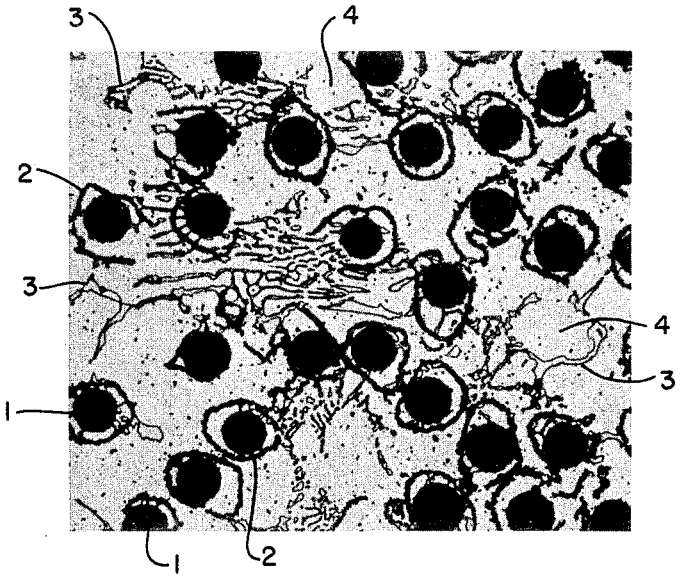
FIG. 1 is a magnified cross-section of a graphite fiber, aluminum matrix composite wherein the graphite fibers have been first coated with nickel and then coated with copper.

Referring now more particularly to the drawings, it will be seen that in FIG. 1 there is shown a magnified cross-section of a composite containing grahite fibers 1 which previously had been coated with successive coatings of nickel and copper. A reacted coating 2 around the individual fibers 1 may also be observed. A copper-rich phase 3 in the aluminum matrix 4 indicates that the copper coating has been sacrificed and incorporated into the aluminum.

Figure 2:
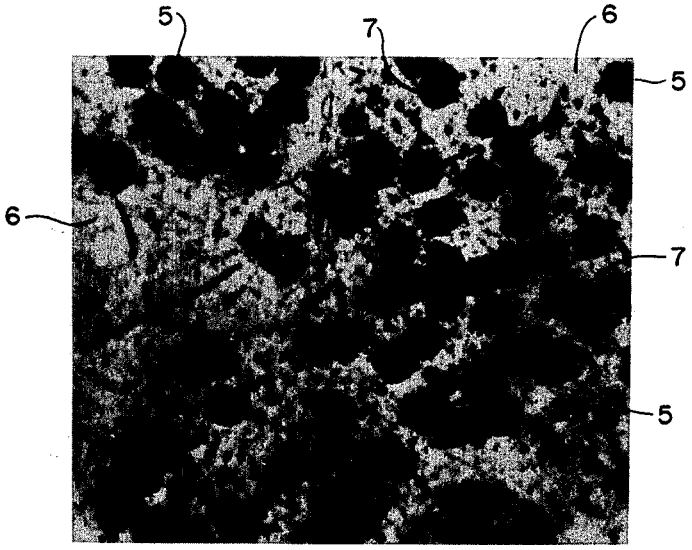
FIG. 2 is a magnified cross-section of graphite fibers which have been coated with nickel and then coated with copper, and immersed in a molten babbitt alloy consisting of five percent antimony, five percent copper, and the balance tin.

Referring now more particularly to FIG. 2, there is shown a graphite fiber material known as "Thornel 300" which is manufactured by the Union Carbide Corporation. The material is made from polyacrylonitrile and is shown at 5. This material, which had been coated first with nickel and then with copper was immersed in liquid babbitt metal 6 which is shown to be intimately bonded to the nickel coating 7 which encircles the graphite fibers 5—5. The copper coating which had been on the nickel coating has been sacrificed and has been dissolved in the babbitt matrix.

The following examples of fiber and matrix compositions which have been prepared in accordance with the present invention, will illustrate the application of the invention to a variety of materials.

EXAMPLE 1

A ceramic/lead alloy composite material was produced as follows: The ceramic fiber was NEXTEL 312 which is manufactured by the 3M Company and which consists of four continuous strands having 390 filaments each. This material was dipped into an electroless nickel solution essentially containing nickel chloride and sodium hypophosphite in water at 90° C. The ceramic fiber was removed from the solution after 30 seconds and heated at 300° C. in air until a black coating of metallic nickel was obtained, whereupon the fiber was returned to the electroless nickel solution for several minutes until a nickel coating about 0.5 micrometers thick was deposited. The nickel coated fiber was then electroless copper plated in a solution essentially containing copper sulfate and formaldehyde in water at 25° C. The fiber was held in solution for about 15 minutes or until about 0.5 micrometers thick copper was deposited. The nickel/copper plated fiber was then transferred to a silver cyanide plating bath at 25° C. in which 0.1 micrometers of silver was electroplated at one amp/sq dm. Microscopic examination after plating revealed that all the filaments in the fiber bundle were evenly coated with metal.

A composite ceramic/lead rod was formed with the above coated material by laying about ten strands of yarn into a bundle and immersing this below the surface of a molten lead bath maintained in air at 450° C. Upon withdrawing and cooling the composite it was found that the rod was stiff and evenly coated on the outside with lead. Microscopic examination of a cross-section of this material revealed that lead had infiltrated all the innerspace between the filaments and was closely bonded to the ring of nickel which had been previously plated on the ceramic and which remained adherent to the fiber.

EXAMPLE 2

An aluminum oxide fiber known as "Fiber FP" is manufactured by E. I. Dupont De Nemours and Company. This fiber was also treated as the ceramic fiber in Example 1 with an electroless nickel coating 0.6 micrometers thick and electroless copper 0.8 micrometers thick, followed by silver plating of approximately 0.1 micrometers. This fiber became infiltrated with lead and became quite stiff when withdrawn and cooled after immersion in molten lead at 450° C. for 30 seconds.

EXAMPLE 3

A continuous graphite fiber material known as "Thornel" Type P Grade VSB-32" manufactured by the Union Carbide Corporation is made from pitch. This fiber consists of 2000 filaments in a continuous strand, and has tensile strength of about 300,000 lb/sq inch and tensile modulus of 50 million lbs/sq inch. Thus, it can significantly enhance strength and stiffness when incorporated into a metal matrix.

These graphite fibers were electroplated with nickel by passing them through an aqueous solution of nickel sulfamate and boric acid maintained at 50° C. The residence time in the plating solution was two minutes and the plating current density was two amp/sq dm. A copper coating was electroplated over the nickel coated graphite by passing the continuous fiber through an aqueous solution of copper cyanide maintained at 60° C. and applying a direct current of 1.5 amp/sq dm for two minutes. The total coating thickness was about 2.5 micrometers, made up of equal layers of nickel and copper. Understandably the nickel and copper could have been built up by the method of electroless plating as in Example 1; however, electroplating offers advantages of economy and speed of deposition.

A graphite/aluminum composite wire 0.050 inch in diameter was produced by passing the nickel/copper plated yarn under the surface of molten aluminum maintained in air at 750° C. The plated yarn was drawn through the melt at 40 inches per minute so that the residence time was about six seconds. The wire so produced was free from voids and was characterized by exceptional stiffness and a tensile strength of about 50,000 lb/sq inch and the calculated volume loading was 11 volume percent.

A magnified cross-section of the composite aluminum wire is shown in FIG. 1.

EXAMPLE 4

Graphite yarn, nickel and copper coated as in Example 2, was handwoven into a simple basket weave to form a bidirectional cloth. This woven material was flexible and easily handled without fraying or filament breakage. When the woven material was immersed for 15 seconds beneath the surface of molten aluminum maintained in air at 750° C., spontaneous wetting and infiltration of the graphite occurred. Upon cooling, a very rigid graphite/aluminum plaque resulted.

EXAMPLE 5

A graphite/lead composite bar was made by conventional investment casting in a plaster mold. Type P graphite fibers were first electroless plated with 0.5 micrometers nickel from an aqueous solution of nickel acetate and dimethylamine borane maintained at 75° C. Subsequently, the continuous fibers were electroplated with 0.7 micrometers copper from a copper cyanide plating bath in a manner similar to that described in Example 3. Finally, the nickel/copper coated fibers were passed through a silver cyanide solution whereupon a thin coating of silver was chemically displaced onto the copper coating of the fibers. When a bundle of these fibers was placed in a ⅛th inch by ⅛th inch by 8 inch long plaster mold cavity and molten lead at 500° C. was applied, the cavity was completely filled and the coated fibers were incorporated within the cast lead bar.

The resultant graphite/lead cast bar was characterized by having about ten volume percent of graphite fibers well infiltrated with lead. The bar was much stiffer than pure lead and had a tensile strength of about 30,000 lb/sq inch which is significantly stronger than lead without fiber reinforcement.

EXAMPLE 6

A widely used continuous graphite yarn material known as "Thornel 300" is manufactured by the Union Carbide Corporation. This material is made from polyacrylonitrile and consists of 3000 filaments of seven micrometers diameter each.

Thornel yarn was first electroplated with about 0.8 micrometers nickel by passing the continuous fiber through an aqueous solution of nickel sulfamate and boric acid maintained at 50° C. The residence time in the solution was three minutes and the plating current was eight amperes. On the nickel coating a copper deposit was then applied in a copper cyanide bath maintained at 60° C. An average coating thickness of one micrometer of copper was applied in two minutes at a plating current of ten amperes.

Ten strands of the nickel/copper plated graphite yarn were tied into a bundle and immersed into a molten babbitt alloy consisting of five percent antimony, five percent copper, and the balance tin. The babbitt alloy was maintained at 400° C. in air. Upon withdrawal and cooling of the casting a stiff and well infiltrated rod about 0.15 inch diameter and about five inches long was obtained. A magnified cross-section of the composite graphite fiber and babbitt matrix is shown in FIG. 2.

In order to obtain optimum infiltration of the fibrous materials by the molten matrix, it has been found that a minimum coating thickness of nickel of 0.5 micrometers and of 0.5 micrometers of subsequent copper coating are necessary.

The following example will illustrate the importance of this minimum thickness:

EXAMPLE 7

The bulk density of a graphite aluminum composite can be minimized if the total coating thickness of copper and nickel (both materials denser than aluminum) are low. As shown in Example 3, about one micrometer each of the copper and nickel coatings were effective for producing an aluminum graphite composite in air. In the present example, thicknesses of less than one micrometer were applied to graphite fibers.

In four separate experiments, incremental thicknesses of 0.2 micrometers nickel and copper were applied to graphite fibers in steps of 0.2, 0.4, 0.6, and 0.8 micrometers, respectively. After coating, the fibers were held below the surface of an aluminum melt maintained at 750° C. in air and drawn through at a rate such that the total time of immersion was about six seconds.

It was found that the fibers coated with 0.2 and 0.4 micrometers each of nickel and copper were not completely infiltrated with aluminum but the fibers coated with 0.6 and 0.8 micrometers each of copper and nickel were quite stiff and well infiltrated. A fifth coating thickness of 0.5 micrometers each of nickel and copper was therefore tested in the above manner and it also became well infiltrated indicating that 0.5 micrometers of nickel and copper is an effective lower coating thickness limit.

It should be especially noted that all of the above examples and this process may be carried out under ordinary atmospheric conditions without the use of special vacuum furnaces or protective atmospheres.

While this invention has been described in its preferred embodiment, it is appreciated that variations thereon may be made without departing from the proper scope and spirit of the invention.

What is claimed is:

1. A method of treating a fiber, selected from the group consisting of graphite and ceramics, comprising the steps of:

coating said fiber with nickel, coating said nickel-coated fiber with copper, coating said nickel and copper-coated fiber with a noble metal, immersing said coated fiber in molten metal in the absence of a vacuum or protective atmosphere, said molten metal being selected from the group consisting of lead, aluminum, tin, or alloys thereof in which said lead, aluminum or tin is the base metal.

2. The method of claim 1 wherein said noble metal is silver.

3. The method of claim 2 wherein the molten metal bath is selected from the group consisting of lead and lead alloys.

4. A method of treating a fiber, selected from the group consisting of graphite and ceramics, comprising the steps of:

coating said fiber with nickel, coating said nickel-coated fiber with copper, immersing said coated fiber in molten metal in the absence of a vacuum or protective atmosphere, said molten metal being selected from the group consisting of aluminum, tin, or alloys thereof in which said aluminum or tin is the base metal.

5. The method of claim 4 wherein the thickness of the nickel coating on said fiber and the thickness of the copper coating on said fiber are each at least 0.5 micrometers.

6. The method of claim 4 wherein said fiber is ceramic and said nickel coating is applied by the electroless process.

7. The method of claim 6 wherein said fiber is coated with nickel by immersing said fiber in a bath containing nickel chloride and sodium hypophosphite, removing said fiber from said bath and heating said fiber to approximately 300° C. in air until a black coating of metallic nickel is obtained, then immersing said fiber in said bath containing nickel chloride and sodium hypophosphite until a nickel coating at least 0.5 micrometers thick on said fiber is deposited.

8. The method of claim 4 wherein said fiber is graphite and said nickel coating is applied by electroplating.

9. The method of claim 4 wherein the molten metal bath is selected from the group consisting of aluminum and aluminum alloys.

10. The method of claim 4 wherein the molten metal bath is selected from the group consisting of tin and tin alloys.

11. The method of claim 4 wherein the molten metal bath is a tin base babbitt alloy.

* * * * *